US011854503B2

(12) United States Patent
Chang

(10) Patent No.: US 11,854,503 B2
(45) Date of Patent: Dec. 26, 2023

(54) WIRELESS ELECTRONIC LABEL AND SYSTEM COMPRISING THE SAME

(71) Applicant: NANJING SILERGY MICRO (HK) CO., LIMITED, Causeway Bay (HK)

(72) Inventor: Chia-Lin Chang, Causeway Bay (HK)

(73) Assignee: NANJING SILERGY MICRO (HK) CO., LIMITED, Causeway Bay (HK)

( * ) Notice: Subject to any disclaimer, the term of this patent is extended or adjusted under 35 U.S.C. 154(b) by 0 days.

(21) Appl. No.: 17/396,798

(22) Filed: Aug. 9, 2021

(65) Prior Publication Data

US 2022/0068230 A1 Mar. 3, 2022

(30) Foreign Application Priority Data

Aug. 25, 2020 (TW) ..... 109129000

(51) Int. Cl.
*G09G 3/34* (2006.01)
*H01Q 1/24* (2006.01)

(52) U.S. Cl.
CPC ..... *G09G 3/3453* (2013.01); *H01Q 1/248* (2013.01); *G09G 2330/02* (2013.01); *G09G 2370/16* (2013.01); *G09G 2380/04* (2013.01)

(58) Field of Classification Search
CPC ..... G09G 3/3453; G09G 2330/02; G09G 2370/16; G09G 2380/04; H01Q 1/248
See application file for complete search history.

(56) References Cited

U.S. PATENT DOCUMENTS 4,611,166 A * 9/1986 Aslan ..... G01R 1/07 324/95
2011/0269397 A1 11/2011 Bella et al.
2016/0093939 A1* 3/2016 Kim ..... H01Q 1/44 343/720
2020/0209995 A1* 7/2020 So ..... H01Q 1/24
2022/0352620 A1* 11/2022 Morimoto ..... H01Q 9/065

FOREIGN PATENT DOCUMENTS

CA 2214783 A1 * 9/1996 ..... G06K 7/0008
CN 203338386 12/2013
CN 110165757 8/2019
JP 3877196 B2 * 2/2007 ..... H01Q 14/14
JP 2019047481 * 3/2019 ..... H01Q 1/42
JP 2019047481 A * 3/2019 ..... H01P 3/003
KR 20150008101 A * 1/2015 ..... G08B 13/2417
WO 1110138 * 3/2000 ..... G06F 3/147

* cited by examiner

*Primary Examiner* — Towfiq Elahi
(74) *Attorney, Agent, or Firm* — AMIN, TUROCY & WATSON, LLP

(57) ABSTRACT

A wireless electronic label comprises a display module, a rectenna module and a control drive module. The display module has a display surface. The rectenna module is disposed on the display surface of the display module. The rectenna module is used to receive an electromagnetic wave signal and convert it into an electrical energy signal. The rectenna module is made of light-transmitting electronically conductive material. The control drive module is used to convert the electrical energy signal into electrical energy to power the wireless electronic label and to send a command signal to the display module. The display module is further used to display a label signal on the display surface according to the command signal.

10 Claims, 7 Drawing Sheets

WIRELESS ELECTRONIC LABEL AND SYSTEM COMPRISING THE SAME

RELATED APPLICATIONS

Figure 1A:
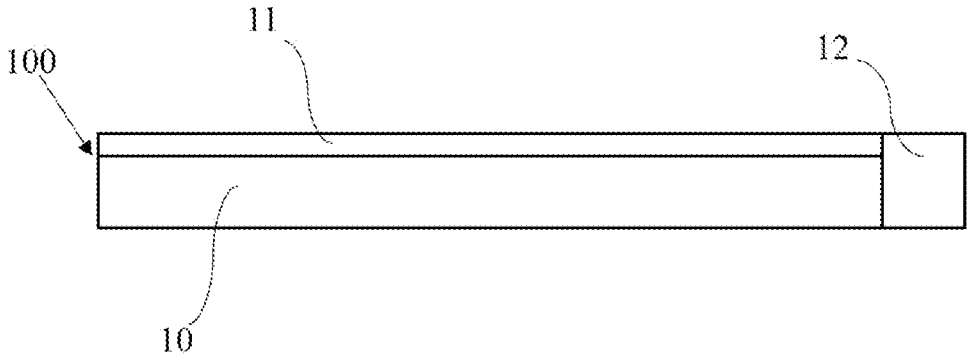

The present application claims the priority of Taiwan Application No. 109129000, filed Aug. 25, 2020, the disclosure of which is hereby incorporated by reference herein in its entirety.

BACKGROUND OF THE INVENTION

1. Field of the Invention

The present disclosure generally relates to a wireless electronic label, and, more particularly, to a wireless electronic label capable of being controlled through wireless communication and a system comprising the same.

2. Description of the Related Art

In general, a wireless electronic label which is also known as electronic shelf label (ESL) is often used in shops, stores, or department stores for displaying product pricing and related information. A wireless electronic label can also replace a paper label or a card. One of the advantages of the wireless electronic label is that the information displayed on ESL can be updated freely. The wireless electronic label in the prior art comprises an antenna instead of an input device in order to further reduce the size of the wireless electronic label. The antenna of the wireless electronic label is used to receive a wireless signal from an external control device to update the information displayed on it.

However, an antenna and a display unit in the wireless electronic label in the prior art are designed to avoid overlapping each other in order to prevent the antenna from shielding the display unit of the wireless electronic label or prevent the display unit from obstructing the wireless signals received by the antenna. In other words, the volume or area of the wireless electronic label will be increased due to the antenna, and it is also necessary to find another space for the battery for the wireless electronic label. Therefore, how to provide a wireless electronic label and a system comprising the wireless electronic label with a smaller size has become an urgent problem to be solved in the industry.

SUMMARY OF THE INVENTION

In light of solving the foregoing problems of the prior art, the present invention provides a wireless electronic label comprising a display module, a rectenna module and a control drive module. The display module has a display surface. The rectenna module is disposed on the display surface of the display module. The rectenna module is used to receive an electromagnetic wave signal and convert it into an electrical energy signal. The rectenna module is made of light-transmitting electronically conductive material. The control drive module is used to convert the electrical energy signal into electrical energy to power the wireless electronic label and used to send a command signal to the display module. The display module is further used to display a label signal on the display surface according to the command signal.

In an embodiment, the rectenna module has a transmittance of between 50% and 95%.

In an embodiment, the rectenna module is made of metal grid, ITO, graphene film or sputtered thin metal film.

In an embodiment, the rectenna module comprises at least one dipole antenna and at least one diode. The diode is connected with the dipole antenna to form a circuit that converts the electromagnetic wave signal into the electric energy signal.

In an embodiment, the control drive module further comprises a rectifying and filtering unit. The rectifying and filtering unit is used to receive the electric energy signal output by the rectenna module, and convert the electric energy signal into the electric energy.

In an embodiment, the control drive module further comprises an energy storage unit. The energy storage unit is used to store the electric energy output by the rectifying and filtering unit, and supply power to the display module.

In an embodiment, the energy storage unit is a solid-state battery, a rechargeable battery or a super capacitor.

In an embodiment, the display module is ePaper.

In an embodiment, the control drive module further comprises a signal antenna unit. The signal antenna unit is used to receive a wireless control signal, wherein the control drive module is further used to generate the command signal according to the wireless control signal.

In an embodiment, the control drive module is further used to generate a report signal and send the report signal through the signal antenna unit.

The present invention also provides a wireless electronic label system, comprising: a wireless electronic label according to any one of said embodiments; and a remote control device used to generate a wireless control signal, and send the wireless control signal to the control drive module by wireless communication.

Compared to the prior art, a light-transmitting electronically conductive material is used to form the rectenna module of the wireless electronic label according to the present invention uses. By doing so, the rectenna module can be disposed on the display surface of the display module without hindering the display of the display module. The space above the display surface of the display module can be used effectively, so that the effect of reducing the volume or area of the wireless electronic label can be achieved. In addition, the control drive module of the wireless electronic label according to the present invention can further comprise a rectifying and filtering unit, an energy storage unit or a signal antenna unit. The signal antenna unit is used to receive a wireless control signal. The electric energy signal is converted into electric energy through the rectifying and filtering unit and the electric energy is stored by the energy storage unit and the electric energy could be used to power the wireless electronic label according to the present invention. The wireless electronic label according to the present invention would be more space-saving since the batteries can be removed or the batteries can be smaller than that used in the usual wireless electronic label.

BRIEF DESCRIPTION OF THE DRAFLAPS

FIG. 1*a* illustrates a schematic view of a structure of the wireless electronic label according to a first embodiment of the present invention.

Figure 1B:
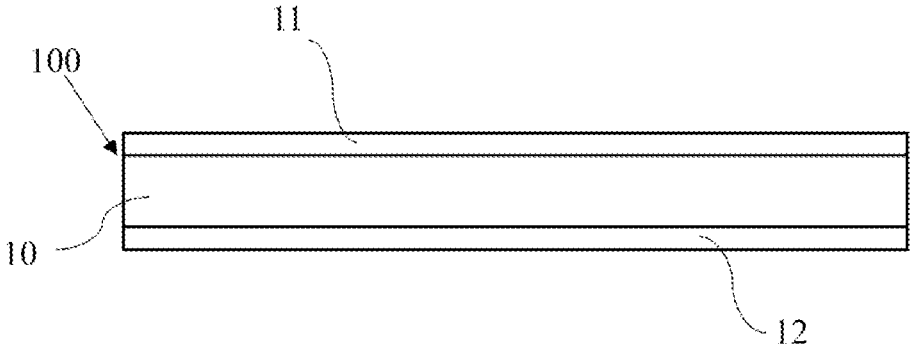

FIG. 1*b* illustrates a schematic view of a structure of the wireless electronic label according to a second embodiment of the present invention.

Figure 1C:
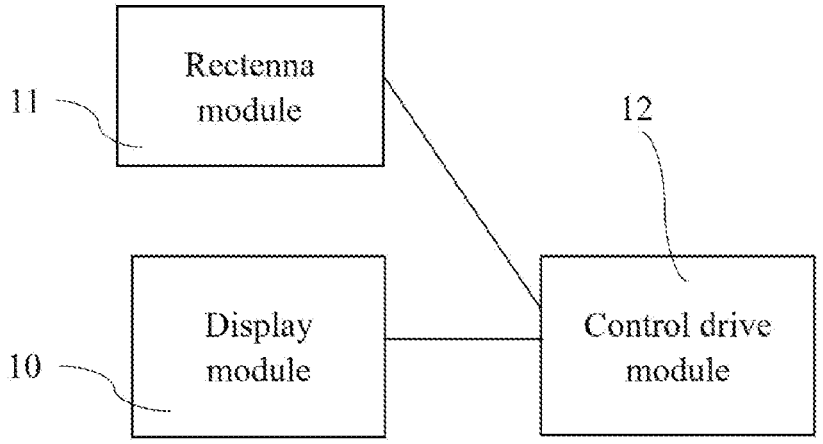

FIG. 1*c* illustrates a schematic view of the functional modules of the wireless electronic label according to the first or second embodiment of the present invention.

Figure 2:
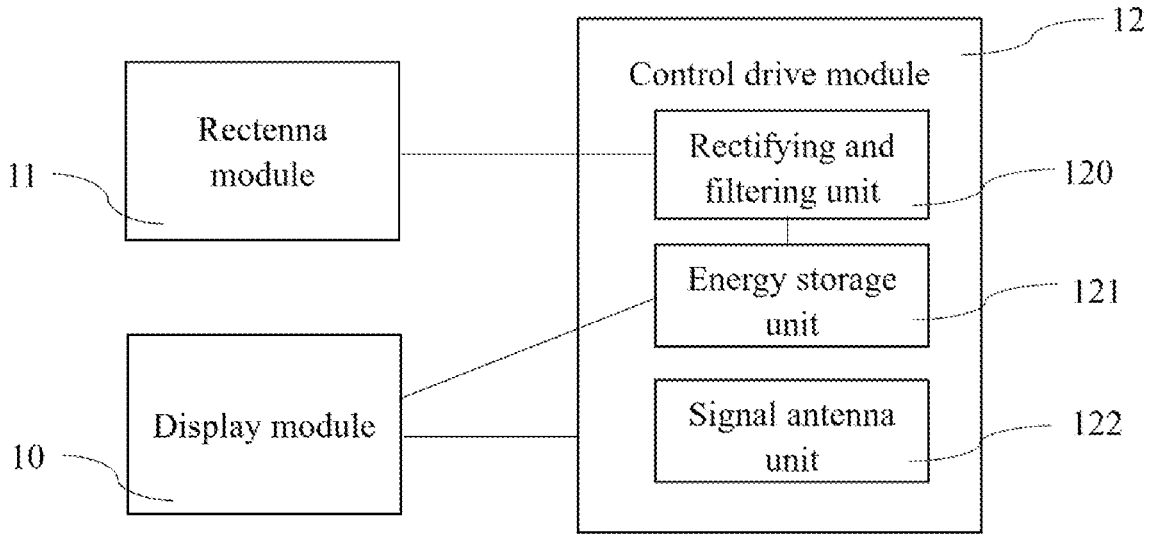

FIG. 2 illustrates a schematic view of the functional modules of the wireless electronic label according to the third embodiment of the present invention.

Figure 3A:
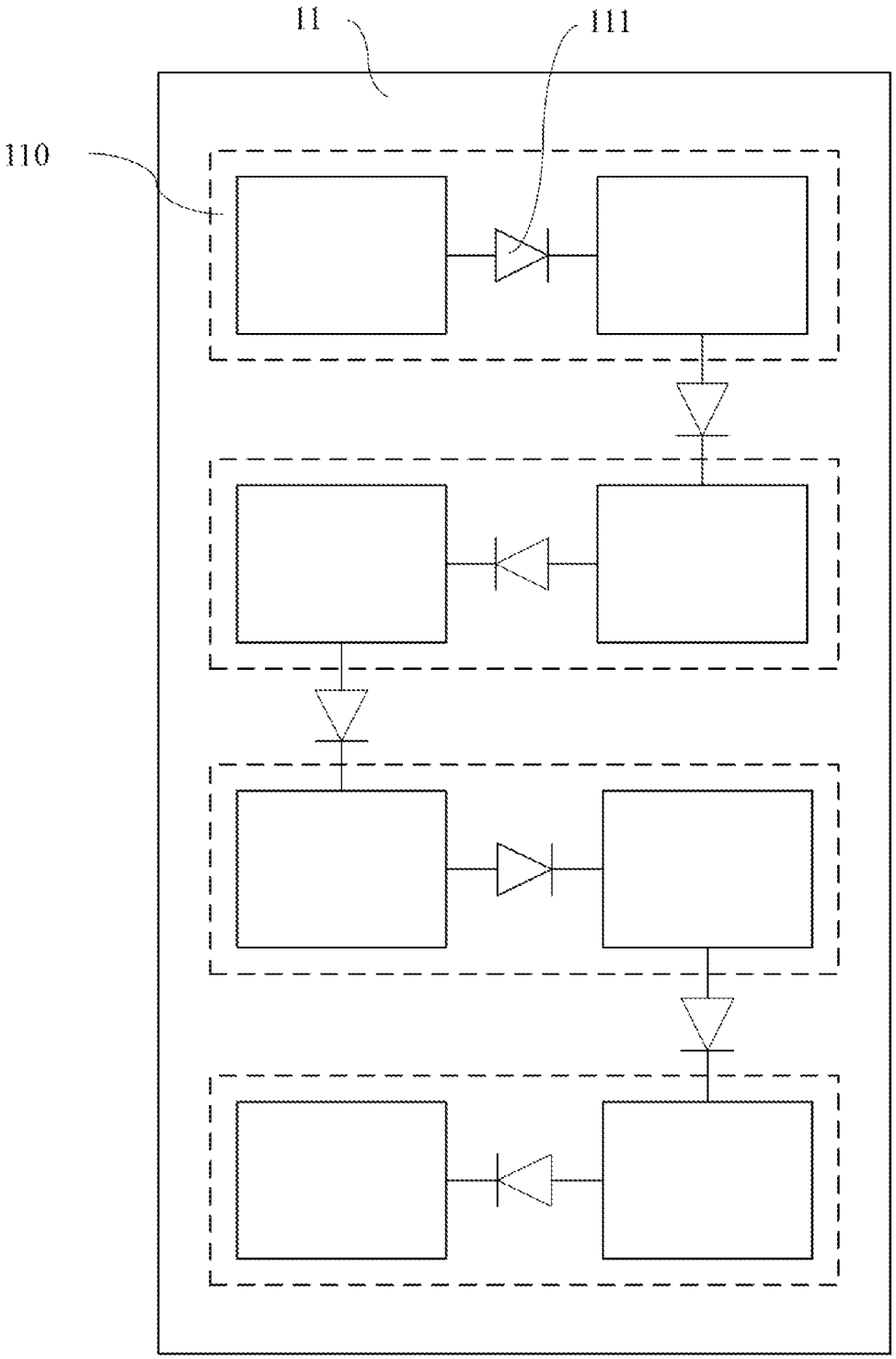

FIG. 3*a* illustrates a schematic view of a structure of the rectenna module according to a fourth embodiment of the present invention.

Figure 3B:
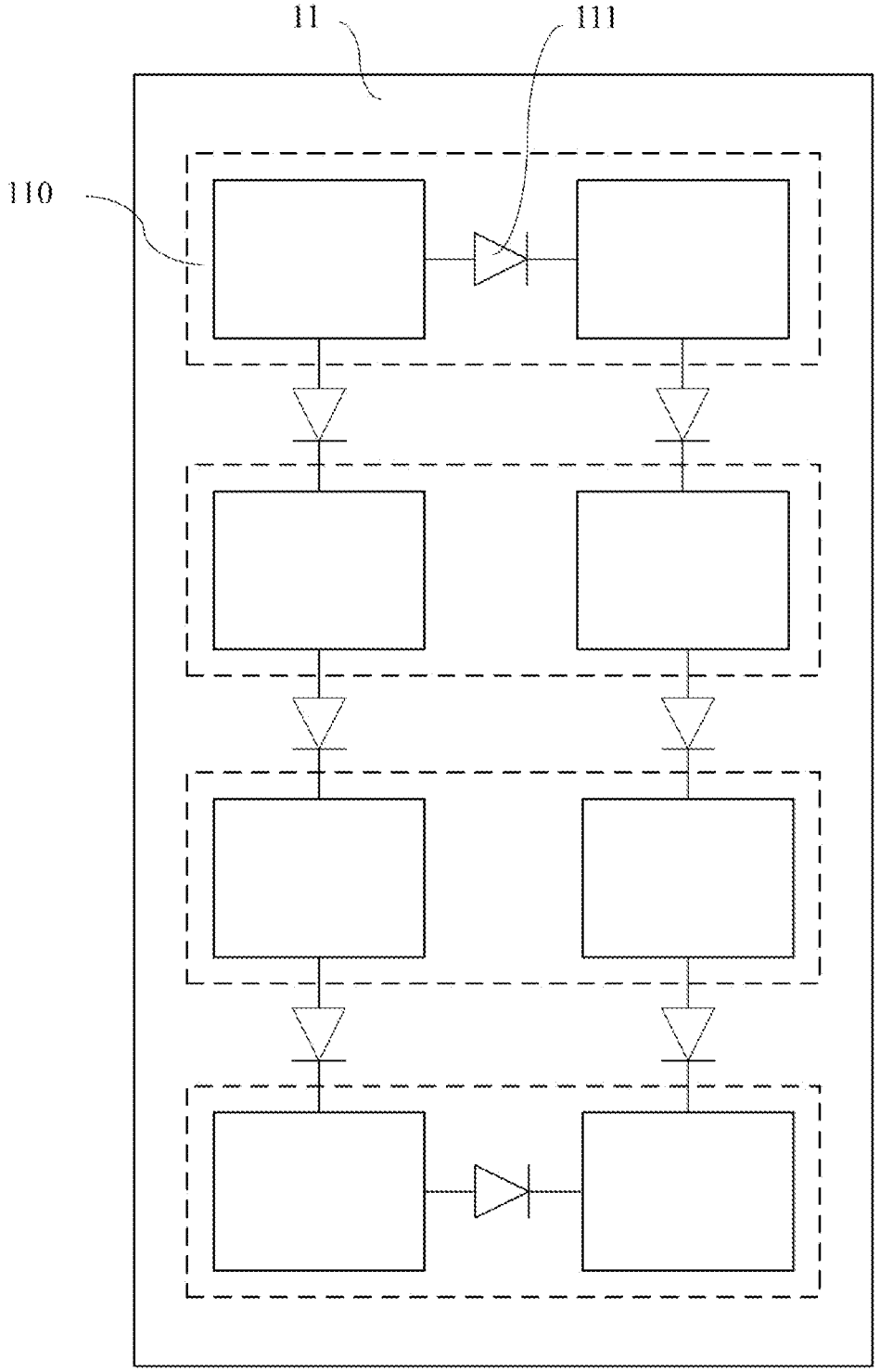

FIG. 3*b* illustrates a schematic view of a structure of the rectenna module according to a fifth embodiment of the present invention.

Figure 3C:
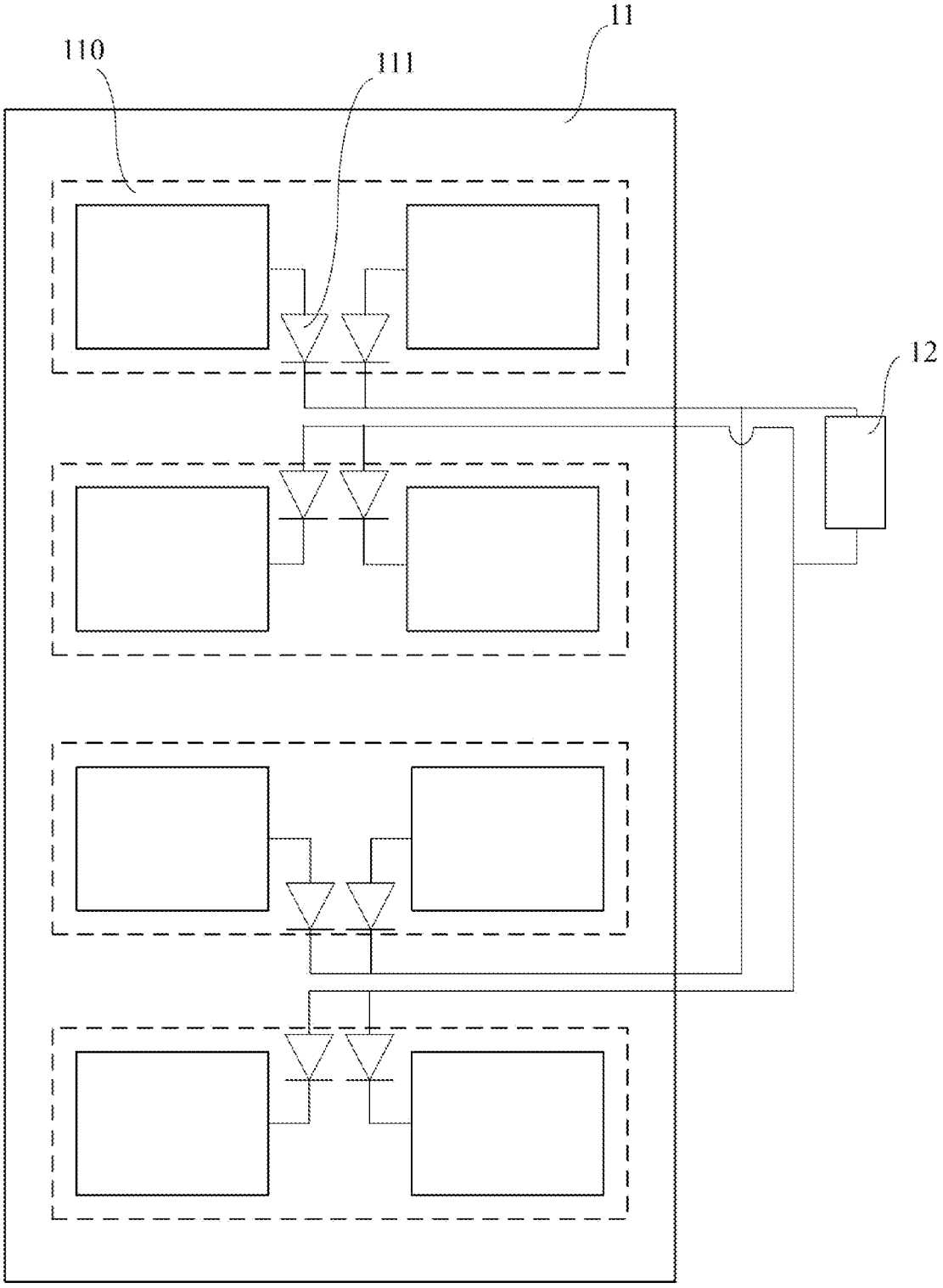

FIG. 3*c* illustrates a schematic view of a structure of the rectenna module according to a sixth embodiment of the present invention.

Figure 4:
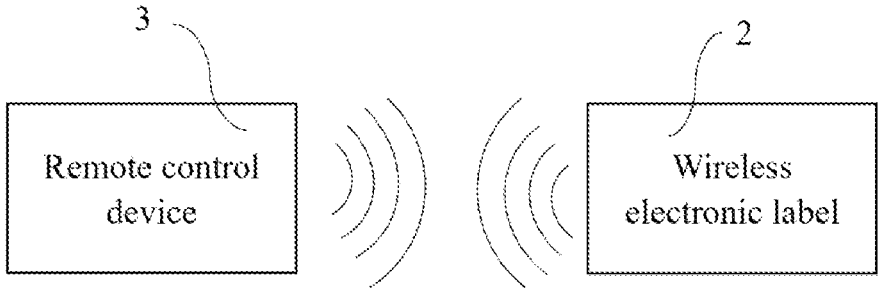

FIG. 4 illustrates a schematic view of a structure of the wireless electronic label system according to a seventh embodiment of the present invention.

DETAILED DESCRIPTION

The present invention is described by the following specific embodiments. Those with ordinary skills in the arts can readily understand other advantages and functions of the present invention after reading the disclosure of this specification. Any changes or adjustments made to their relative relationships, without modifying the substantial technical contents, are also to be construed as within the range implementable by the present invention.

Please refer to FIG. 1*a*, FIG. 1*b* and FIG. 1*c*. FIG. 1*a* illustrates a schematic view of a structure of the wireless electronic label according to a first embodiment of the present invention. FIG. 1*b* illustrates a schematic view of a structure of the wireless electronic label according to a second embodiment of the present invention. FIG. 1*c* illustrates a schematic view of the functional modules of the wireless electronic label according to the first or second embodiment of the present invention. As shown in figures, the wireless electronic label according to the present invention comprises a display module 10, a rectenna module 11 and a control drive module 12.

The display module 10 has a display surface 100. All or part of the area on the display surface 100 can be used to display label signals, such as patterns or words. The rectenna module 11 may be disposed on the display surface 100 of the display module 10. The rectenna module 11 is used to receive an electromagnetic wave signal and convert it into an electrical energy signal. The rectenna module 11 is made of light-transmitting and electronically conductive material. According to the present invention, a rectenna is a rectifying antenna, which may be a combination of a rectifier and an antenna.

The control drive module 12 is used to convert the electrical energy signal into electrical energy to power the wireless electronic label and used to send a command signal to the display module 10. The display module 10 may be further used to display a label signal on the display surface 100 according to the command signal. In the first embodiment of the present invention, the control drive module 12 is disposed on one side of the display module 10. In the second embodiment of the present invention, the control drive module 12 is disposed on the back of the display module 10 which is on the side opposite to the display surface 100. In other embodiments of the present invention, the control drive module 12 may also be disposed on the display surface 100 of the display module 10, but not limited thereto. The control drive module 12 may be implemented by components such as a microcontroller (MCU) or a driver circuit.

The rectenna module 11 is used to receive an electromagnetic wave signal and convert the electromagnetic wave signal into an electrical energy signal. It can support long-distance power supply, so that batteries may be unnecessary for the wireless electronic label of the present invention. Or, a smaller power storage device with less energy may be used in the wireless electronic label of the present invention. Since the rectenna module 11 is made of light-transmitting electronically conductive material, it will not block the label signals on the display surface 100. Therefore, all areas on the display surface 100 can be used for disposing the rectenna module 11. Compared to the prior art, under the condition that the display area of the display surface 100 has the same area, the wireless electronic label of the present invention may have a smaller size.

In an embodiment, the rectenna module 11 may have a transmittance of between 50% and 95%, but not limited thereto. The rectenna module 11 may be made of metal grid, ITO, graphene film or sputtered thin metal film, but not limited thereto.

Please refer to FIG. 2. FIG. 2 illustrates a schematic view of the functional modules of the wireless electronic label according to the third embodiment of the present invention. In an embodiment, the control drive module 12 can further comprise a rectifying and filtering unit 120. The rectifying and filtering unit 120 is used to receive the electric energy signal output by the rectenna module 11 and the rectifying and filtering unit 120 may further convert the electric energy signal into the electric energy. The rectifying and filtering unit 120 may comprise components such as a matching circuit, a rectifier circuit, a direct-current (DC) pass filter, or a power management unit (PMU).

In an embodiment, the control drive module can further comprise an energy storage unit 121. The energy storage unit 121 is used to store the electric energy output by the rectifying and filtering unit 120. The energy storage unit 121 may further supply the electric energy to the display module 10. The energy storage unit can be a solid-state battery, a rechargeable battery or a super capacitor, but not limited thereto. The wireless electronic label of the present invention can work continuously without replacing the energy storage unit 121, which may be charged wirelessly by the rectenna module 11 and the rectifying and filtering unit 120.

In an embodiment, the control drive module 12 can further comprise a signal antenna unit 122. The signal antenna unit 122 is used to receive a wireless control signal. The control drive module 12 is further used to generate the command signal according to the wireless control signal. By the rectenna module 11 and the signal antenna unit 122, the wireless electronic label according to the present invention can realize long-distance communication and long-distance charging simultaneously. For example, the signal antenna unit 122 can receive wireless control signals through the Bluetooth communication frequency band, and the rectenna module 11 may receive electromagnetic wave signals by the ISM Band (for example, 915 MHz), but not limited thereto. In other embodiments, the signal antenna unit 122 and the rectenna module 11 can also use other frequency bands, for example, but not limited to, receiving 2.4 GHz or 5 GHz electromagnetic wave signals under IEEE 802.11 standards. In addition, the frequency bands used by the signal antenna unit 122 and the rectifier module 11 may be the same or different.

In a further embodiment, the signal antenna unit 122 can be made of light-transmitting electronically conductive material and can be disposed on the display surface 100 of the display module 10, but not limited thereto.

In an embodiment, the control drive module 12 is further used to generate a report signal and send the report signal through the signal antenna unit 122. The control drive module 12 can generate a report signal when the label signal of the display module 10 is updated completely or an abnormal state occurs. Then the control drive module 12 sends the report signal through the signal antenna unit 122 to notify an external device.

Please refer to FIG. 3*a*, FIG. 3*b* and FIG. 3*c*. FIG. 3*a*, FIG. 3*b* and FIG. 3*c* illustrate schematic views of a structure of the rectenna module according to the fourth to sixth embodiments of the present invention, respectively. As shown in the figures, the rectenna module 11 can comprise at least one dipole antenna 110 and at least one diode 111. The diode 111 are connected with the dipole antenna 110 to form a circuit that converts the electromagnetic wave signal into the electric energy signal. The dipole antenna 110 may comprise a pair of conductors symmetrically placed. As shown in FIG. 3*a*, FIG. 3*b* and FIG. 3*c*, two symmetrical conductors are enclosed by dashed lines (the dipole 111 is not included). The dipole antenna 110 comprises two identical rectangular conductors placed symmetrically in the embodiments of FIG. 3*a*, FIG. 3*b* and FIG. 3*c*, but not limited thereto. The dipole antenna 110 may comprises conductors of other shapes. In addition, The numbers of dipole antenna 110 and diodes 111 can also be adjusted according to factors such as the connection mode or the area of the wireless electronic label, and the present invention is not limited to the particular methodology, compounds, materials, manufacturing techniques, uses, and applications, described herein.

As shown in FIG. 3*a*, FIG. 3*b* and FIG. 3*c*, the circuit formed by the connection of the dipole antenna 110 and the diodes 111 can convert and rectify the electromagnetic wave signal into the electrical energy signal. By changing the connection of the dipole antenna 110 and the diodes 111, electromagnetic wave signals of different polar directions can be received, and further the conversion efficiency can be adjusted. In addition, in the structure of these embodiments, the dipole antenna 110 and the diodes 111 can also be disposed on the same surface and conjugate matching can be achieved without other matching circuits.

In an embodiment, the display module 10 can be ePaper, but not limited thereto.

Please refer to FIG. 4, FIG. 4 illustrates a schematic view of a structure of the wireless electronic label system according to a seventh embodiment of the present invention. The present invention also provides a wireless electronic label system. The wireless electronic label system comprises a wireless electronic label 2 according to any one of said embodiments of the present invention, and a remote control device 3 used to generate a wireless control signal and send the wireless control signal to the control drive module 12 by wireless communication. The remote control device 3 can be an electronic device with a wireless communication function and an input interface, such as a computer, a server, or a mobile device. The remote control device 3 can also be configured on unmanned vehicles, such as drones, sweeping robots, or the like to help fix the dead spots in communication.

In summary, the wireless electronic label according to the present invention comprises the rectenna module made of light-transmitting electronically conductive material. Therefore, the rectenna module can be disposed on the display surface of the display module without blocking the information displayed on the display module. The space above the display surface of the display module can be utilized effectively, so that the effect of reducing the volume or area of the wireless electronic label can be achieved. Besides, the control drive module can further comprise a rectifying and filtering unit, an energy storage unit or a signal antenna unit. The signal antenna unit is used to receive a wireless control signal. The electric energy signal is converted into electric energy by the rectifying and filtering unit and stored by the energy storage unit. The electric energy could be used to power the wireless electronic label according to the present invention. The wireless electronic label according to the present invention would be more space-saving since the batteries can be removed or the batteries can be smaller than that used in the usual wireless electronic label.

The foregoing descriptions of the detailed embodiments are only illustrated to disclose the features and functions of the present invention and not restrictive of the scope of the present invention. It should be understood to those in the art that all modifications and variations according to the spirit and principle in the disclosure of the present invention should fall within the scope of the appended claims.

What is claimed is:

1. A wireless electronic label, comprising:

a display module with a display surface, wherein top of the display module is configured as the display surface of the display module, wherein the display surface is configured to display information;

a rectenna module adjoining the top of the display module, wherein the rectenna module is used to receive an electromagnetic wave signal and convert the electromagnetic wave signal into an electrical energy signal, wherein the rectenna module is made of light-transmitting electronically conductive material; and a control drive module used to convert the electrical energy signal into electrical energy to power the wireless electronic label and used to send a command signal to the display module, wherein the display module is further used to display a label signal on the display surface according to the command signal, wherein the control drive module further comprises:

a signal antenna unit used to receive a wireless control signal, wherein the control drive module is further used to generate the command signal according to the wireless control signal, and wherein the rectenna module has a transmittance of between 50% and 95%.

2. The wireless electronic label of claim 1, wherein the rectenna module is made of metal grid, ITO, graphene film or sputtered thin metal film.

3. The wireless electronic label of claim 1, wherein the rectenna module comprises at least one dipole antenna and at least one diode, wherein the at least one diode is connected with the at least one dipole antenna to form a circuit that converts the electromagnetic wave signal into the electric energy signal.

4. The wireless electronic label of claim 1, wherein the control drive module further comprises:

a rectifying and filtering unit used to receive the electric energy signal output by the rectenna module and convert the electric energy signal into the electric energy.

5. The wireless electronic label of claim 4, wherein the control drive module further comprises:

an energy storage unit used to store the electric energy output by the rectifying and filtering unit, and supply power to the display module.

6. The wireless electronic label of claim 5, wherein the energy storage unit is a solid-state battery, a rechargeable battery or a super capacitor.

7. The wireless electronic label of claim 1, wherein the display module is ePaper.

8. The wireless electronic label of claim 1, wherein the control drive module is further used to generate a report signal and send the report signal through the signal antenna unit.

9. A wireless electronic label system, comprising:

a wireless electronic label according to claim 1; and a remote control device used to generate a wireless control signal and send the wireless control signal to the control drive module by wireless communication.

10. A wireless electronic label system, comprising:

a wireless electronic label according to claim 4; and a remote control device used to generate the wireless control signal and send the wireless control signal to the control drive module by wireless communication.

* * * * *